US011598143B2

(12) United States Patent
Parry

(10) Patent No.: US 11,598,143 B2
(45) Date of Patent: Mar. 7, 2023

(54) JOINT FOR A FENESTRATION UNIT

(71) Applicant: Garner Aluminium Extrusions Limited, Derby (GB)

(72) Inventor: Philip Dayton Parry, Derby (GB)

(73) Assignee: GARNER ALUMINIUM EXTRUSIONS LIMITED, Derby (GB)

( * ) Notice: Subject to any disclaimer, the term of this patent is extended or adjusted under 35 U.S.C. 154(b) by 758 days.

(21) Appl. No.: 16/525,787

(22) Filed: Jul. 30, 2019

(65) Prior Publication Data

US 2020/0032578 A1 Jan. 30, 2020

(30) Foreign Application Priority Data

Jul. 30, 2018 (GB) ..... 1812397

(51) Int. Cl.
*E06B 3/96* (2006.01)
*E06B 3/98* (2006.01)
(Continued)

(52) U.S. Cl.
CPC ..... *E06B 3/9688* (2013.01); *E06B 3/9636* (2013.01); *E06B 3/9645* (2013.01);
(Continued)

(58) Field of Classification Search
CPC ..... E06B 3/96; E06B 3/9624; E06B 3/9636; E06B 3/964; E06B 3/9645; E06B 3/9687;
(Continued)

(56) References Cited

U.S. PATENT DOCUMENTS 4,101,229 A 7/1978 Weibull
10,370,893 B2 * 8/2019 Hooper, Jr ..... E06B 3/26303
(Continued)

FOREIGN PATENT DOCUMENTS

CN 113006637 A * 6/2021 ..... E06B 1/34
DE 2 107 293 8/1972
(Continued)

OTHER PUBLICATIONS

Machine Translation of DE19614942; Kahl, https://worldwide.espacenet.com/patent/search/family/007791393/publication/DE19614942A1?q=DE19614942; Mar. 16, 2022 (Year: 2022).*
(Continued)

*Primary Examiner* — Ryan D Kwiecinski
(74) *Attorney, Agent, or Firm* — Nixon & Vanderhye P.C.

(57) ABSTRACT

A mitre joint for a metallic frame of a fenestration unit includes first and second frame members; a connector configured to locate the first and second frame members in relation to one another; and first and second fasteners configured to secure the first and second frame members to the connector. The connector has a first arm configured to extend within a hollow profile defined by the first frame member, and a second arm configured to extend within a hollow profile defined by the second frame member. A longitudinal axis of each of the first and second fasteners is configured to be parallel to a longitudinal axis of the respective connector arm. Each of the first and second fasteners is configured to engage the respective frame member when the respective connector arm extends within said frame member.

17 Claims, 11 Drawing Sheets

(51) Int. Cl.
*E06B 3/968* (2006.01)
*E06B 3/964* (2006.01)

(52) U.S. Cl.
CPC ..... *E06B 3/9648* (2013.01); *E06B 3/9685* (2013.01); *E06B 3/982* (2013.01)

(58) Field of Classification Search
CPC ..... E06B 3/9688; E06B 3/98; E06B 3/982; E06B 3/9648
See application file for complete search history.

(56) References Cited

U.S. PATENT DOCUMENTS

| | | | | |
|---|---|---|---|---|
| 11,268,318 | B2 * | 3/2022 | Dong | E06B 3/982 |
| 2013/0272777 | A1 * | 10/2013 | Hayter | E04F 10/08 403/205 |
| 2014/0360124 | A1 | 12/2014 | Kim | |

FOREIGN PATENT DOCUMENTS

| | | | | |
|---|---|---|---|---|
| DE | 2107293 | A1 * | 8/1972 | E06B 3/9641 |
| DE | 196 14 942 | | 10/1997 | |
| DE | 19614942 | A1 * | 10/1997 | E06B 3/9725 |
| DE | 20 2015 100 148 | U1 | 4/2015 | |
| DE | 10 2015 015 682 | | 7/2016 | |
| DE | 102015015654 | A1 * | 6/2017 | |
| ES | 2 539 862 | | 7/2015 | |
| FR | 2 341 769 | | 9/1977 | |
| GB | 2 150 182 | | 6/1985 | |
| GB | 2150182 | A * | 6/1985 | E06B 3/9641 |
| KR | 10-2007-0022426 | | 2/2007 | |
| NL | 7504997 | | 11/1976 | |
| WO | WO-2015101680 | A1 * | 7/2015 | E06B 3/9636 |

OTHER PUBLICATIONS

Machine Translation of DE2107293A1; Hemmen, https://worldwide.espacenet.com/patent/search/family/005798903/publication/DE2107293A1?q=DE2107293; Mar. 16, 2022 (Year: 2022).*

Machine Translation of WO2015101680A1; Parra, https://worldwide.espacenet.com/patent/search/family/053490931/publication/WO2015101680A1?q=WO%202015%2F101680; Mar. 16, 2022 (Year: 2022).*

Great Britain Search Report dated Sep. 26, 2018 issued in Great Britain Patent Application No. 1812397.6, 3 pp.

Great Britain Examination Report dated May 15, 2019 issued in Great Britain Patent Application No. 1812397.6, 4 pp.

Extended European Search Report datead Dec. 13, 2019 issued in European Patent Application No. 19188948.4, 7 pp.

* cited by examiner

JOINT FOR A FENESTRATION UNIT

CROSS-REFERENCES TO RELATED APPLICATIONS

This application claims the benefit of Great Britain Patent Application No. 1812397.6, filed Jul. 30, 2018, the entire contents of which are hereby incorporated by reference in this application.

FIELD

The present teachings relate to a mitre joint for a metallic frame of a fenestration unit, to a fenestration unit comprising a mitre joint, to a metallic frame comprising a mitre joint, and to a connector for a mitre joint.

BACKGROUND

Frames for windows, doors and other types of fenestration unit are often provided by connecting a series of frame members with a joint at each corner of the frame.

It is known to assemble a metallic frame for a fenestration unit by attaching frame members to corner connectors, e.g. connecting four frame members at four corner connectors to create a standard four-sided frame. It is known to locate and secure a first frame member to a corner connector, and then to locate and secure a second frame member to that corner connector. Connecting frame members one at a time may be necessary due to the fastener arrangement used, or the design of the corner connector. However, such an arrangement often makes no allowance for inaccuracy during manufacture of the frame components, or damage that may occur to the frame components, for example during transport to a site. Misalignment of the frame members with respect to one another can result, so that a watertight or well insulated seal cannot be formed between a pane and the frame, so that the frame may not allow fitting of the required pane or panel, may not fit within the opening, or may simply not have a neat finish.

Other connection systems require a large investment in specialist machinery to simultaneously connect first and second frame members to a connector. Such systems use punches to deform the frame members to mechanically engage around the connector. This also prevents any subsequent adjustment of the alignment, so if not aligned properly during the operation, both frame members and the connector have to be scrapped.

There are other difficulties with existing joints. Transportation of several individual components may be required, during which components may be mislaid or separated from their assembly/remainder of the assembly. Joints may need to be assembled on site, which can be difficult with a number of intricate components. The fitting between each frame member and the connector may require the end of the frame member to have a particular internal profile, which may involve substantial amounts of material. This can be expensive in particular with e.g. aluminium frames.

The connector may not be well supported by the frame member, and issues of uneven load distribution may arise.

The present teachings seek to overcome or at least mitigate one of more of the problems associated with the prior art.

SUMMARY

A first aspect of the teachings provides a mitre joint for a metallic frame of a fenestration unit, the joint comprising first and second frame members; a connector configured to locate the first and second frame members in relation to one another; and first and second fasteners configured to secure the first and second frame members to the connector. The connector comprises a first arm configured to extend within a hollow profile defined by the first frame member, and a second arm configured to extend within a hollow profile defined by the second frame member. A longitudinal axis of each of the first and second fasteners is configured to be parallel to a longitudinal axis of the respective connector arm. Each of the first and second fasteners is configured to engage the respective frame member when the respective connector arm extends within said frame member.

Such an arrangement provides secure location and fastening of the frame members to the connector.

The first arm may be configured to support the first fastener and the second arm is configured to support the second fastener.

The first and second fasteners can be supported within the connector before the joint is assembled, improving ease of assembly and transportation of the joint components.

Each frame member profile may define at least two projections extending from the profile to engage said fastener.

The projections of the frame member profile engaging the fastener reduce the amount of material required, in contrast to the fastener engaging a solid profile wall of the frame member. The reduced amount of material makes it easier for a thread to be formed, should the fastener be e.g. a self-tapping screw.

There being at least two projections ensures stability of the connection between the fastener and the frame member, and so between the connector and the frame member.

Less than 50% of a periphery of each fastener may be engaged by the projections.

A limited engagement between the fasteners and the frame members makes the fasteners easier to install, due to the reduction in the amount of material. Further it assists in the fasteners being held within the connectors, but being able to be "pulled" into the frame members if the fasteners are threaded and are screwed in.

Each frame member profile may define three projections, or each frame member profile may define four projections.

Each projection of a frame member may engage the fastener at an engagement point, and the projection may be configured such that the engagement points are equidistant about a periphery of the fastener.

The equidistant engagement points improve stability of the connection between each fastener and the respective frame member.

Each frame member profile may define an even number of projections, wherein each projection of a frame member engages the fastener at an engagement point, and the projections may be configured such that the engagement points are arranged in pairs about a periphery of the fastener. The pairs of engagement points may be equidistant one another about the periphery of the fastener.

The substantially opposing points of engagement between each projection and the fastener provide stability to the connection between each fastener and the frame member.

Each projection may extend from the respective frame member profile in a radial direction.

Each fastener may be a threaded fastener. Each projection of a respective frame member may extend to a minor diameter of said fastener. Each fastener may be a grub screw.

Extension of the projections to the minor diameter of the threaded fastener improves the connection between each fastener and frame member.

Each connector arm may define a support for each projection, each support being configured to contact said projection when the connector arm extends within the respective frame member.

The supports improve joint stability, as free movement between the frame members and the connector arms is limited. In turn, this may also enable the amount of material used in the connector to be reduced, since the stability of the joint is not reliant on contact between the connector and external profile walls of the frame members.

Each support may comprise a channel configured to receive the projection, preferably wherein each channel extends to each end of the respective connector arm.

Support is thus provided to the projections along the full length of the connector arm, improving stability and load distribution.

The at least two projections may be configured to locate the first and second arms within the respective frame member profile.

Each connector arm may comprise an inner side, configured for location at an inner side of the projections, and an outer side, configured for location at an outer side of the projections.

Each of the hollow profiles may comprise an inside edge and an outside edge, and wherein the projections may be configured to engage each fastener such that the longitudinal axis of said fastener is positioned within 4 mm in a perpendicular direction of a centreline equidistant between the inside edge and the outside edge of that hollow profile part of the frame member. The longitudinal axis may be within 3 mm of the centreline in a perpendicular direction. The longitudinal axis may be on the centreline. The location of each fastener on the centreline aids load distribution within the frame, so that the pressure exerted by one frame member on the other frame member at the mitre joint can be substantially uniform across the hollow profile part of the joint.

Each connector arm may be configured to engage the respective fastener. Each connector arm may define a recess configured to engage the respective fastener.

Each recess may have at least one concave side wall configured to receive the respective fastener.

Advantageously, the connector can be transported with one or more fasteners already inserted. The fasteners are less likely to be mislaid or confused with other fasteners, and assembly time is saved on site.

Each fastener may be confined in a first axial direction, towards a free end of the connector arm.

This ensures that the connector is "pulled" into the frame member during assembly—i.e. there is one operation of both inserting the connector and securing it in place with the fastener, simplifying assembly Each fastener may be confined in both axial directions.

This enables the connector to also be "pushed" out by the fastener during adjustment or disassembly.

An outer edge of each frame member may define an aperture configured to provide adjustment access to the fastener configured to engage the remaining frame member.

Each fastener may be a threaded fastener. Each fastener may be a self-tapping threaded fastener. Each fastener may comprise a frusto-conical leading end.

Each fastener may comprise at least one threaded axial portion and at least one unthreaded axial portion. Where each connector arm is configured to engage the respective fastener, each connector arm may be configured to engage the respective fastener at an unthreaded portion. The unthreaded portion improves ease of engagement of the fasteners with the connector arm. The first connector arm may meet the second connector arm such that the angle between a longitudinal axis of each of the connector arms is between 60° and 120°, or between 75° and 105°.

The frame members may be at least partially of metallic material.

There is also provided a connector for a joint as described above.

There is further provided an at least partially metallic frame comprising a joint as described above.

There is yet further provided a fenestration unit comprising a joint as described above.

There is also provided a metallic frame member for a fenestration unit, the frame member comprising a hollow profile arranged to receive a connector for securement of the frame member to a further frame member;

wherein the profile defines at least two projections extending from the profile to engage a fastener arranged to secure said connector to the frame member.

The projections of the frame member profile engaging the fastener reduce the amount of material required, in contrast to the fastener engaging a solid profile wall of the frame member. The reduced amount of material makes it easier for a thread to be formed, should the fastener be e.g. a self-tapping screw.

There being at least two projections ensures stability of the connection between the fastener and the frame member, and so between the connector and the frame member.

Less than 50% of a periphery of a fastener may be engaged by the projections.

A limited engagement between the fastener and the frame member makes the fastener easier to install, due to the reduction in the amount of material. Further it assists in the fastener being held within the connector, but being able to be "pulled" into the frame members if the fastener is threaded and is screwed in.

The frame member profile may define three projections, or the frame member profile may define four projections.

Each projection of a frame member may engage the fastener at an engagement point, and the projection may be configured such that the engagement points are equidistant about a periphery of the fastener.

The equidistant engagement points improve stability of the connection between the fastener and the respective frame member.

The frame member profile may define an even number of projections, wherein each projection of a frame member engages the fastener at an engagement point, and the projections may be configured such that the engagement points are arranged in pairs about a periphery of the fastener. The pairs of engagement points may be equidistant one another about the periphery of the fastener.

The substantially opposing points of engagement between each projection and the fastener provide stability to the connection between each fastener and the frame member.

Each projection may extend from the frame member profile in a radial direction.

Each fastener may be a threaded fastener. Each projection of the frame member may extend to a minor diameter of said fastener. Each fastener may be a grub screw.

Extension of the projections to the minor diameter of the threaded fastener improves the connection between each fastener and frame member.

The hollow profile may comprise an inside edge and an outside edge, and the projections may be configured to engage each fastener such that the longitudinal axis of said fastener is positioned within 4 mm in a perpendicular direction of a centreline equidistant between the inside edge and the outside edge of that hollow profile part of the frame member. The longitudinal axis may be within 3 mm of the centreline in a perpendicular direction. The longitudinal axis may be on the centreline. The location of each fastener on the centreline aids load distribution within the frame, so that the pressure exerted by one frame member on another frame member at the mitre joint can be substantially uniform across the hollow profile part of the joint.

An outer edge of the frame member may define an aperture configured to provide adjustment access to the fastener configured to engage another frame member.

Each fastener may be a threaded fastener. Each fastener may be a self-tapping threaded fastener. Each fastener may comprise a frusto-conical leading end.

Each fastener may comprise at least one threaded axial portion and at least one unthreaded axial portion.

DETAILED DESCRIPTION OF EMBODIMENT(S)

Figure 1:
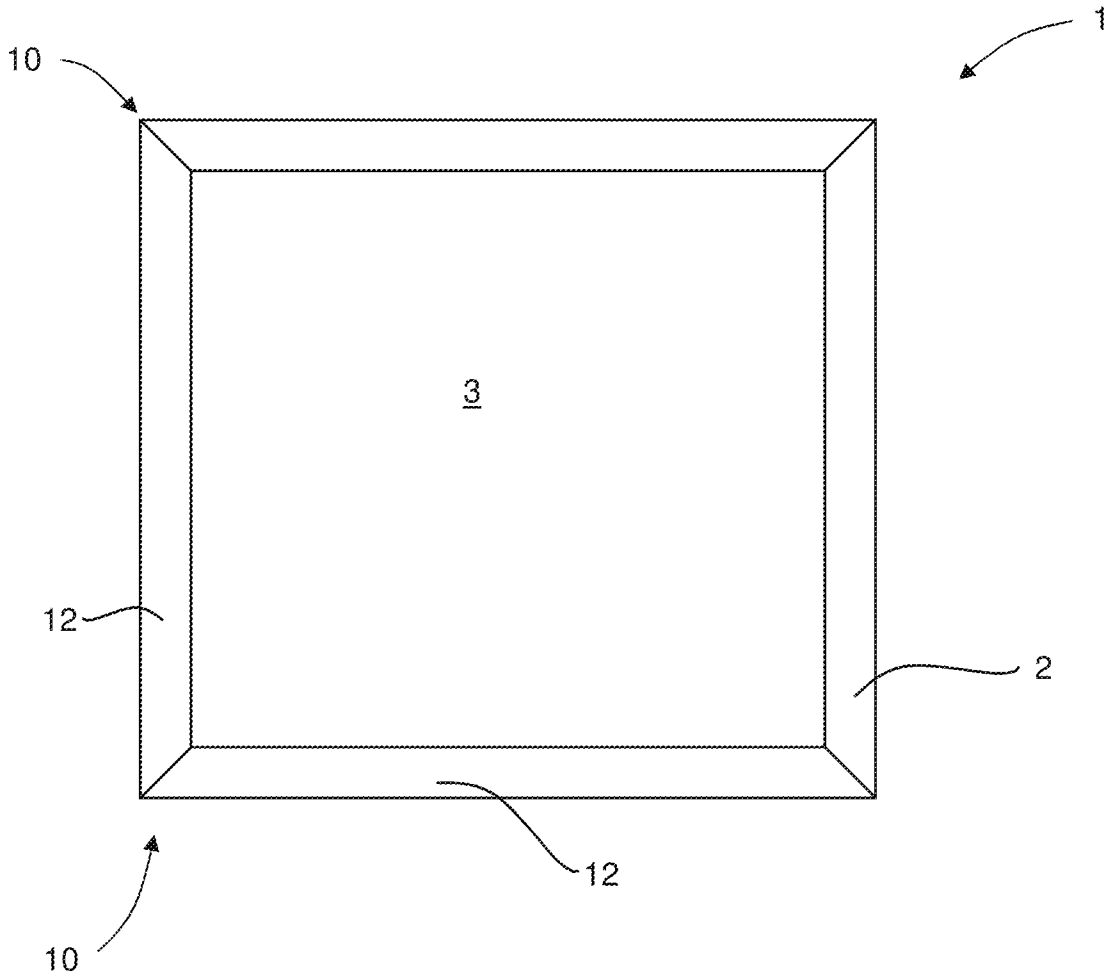
FIG. 1 is a front view of a fenestration unit having a mitre joint according to an embodiment of the present teachings.

FIG. 1 shows a fenestration unit generally indicated at 1. The fenestration unit 1 has a frame 2 made up of a series of frame members 12 connected at mitre joints 10. The fenestration unit 1 of this embodiment is suitable for a window, door or other type of fenestration, such as a vent. The frame 2 supports a pane or panel 3, such as a pane of glass, a double or triple glazed sealed unit, or a panel of wood, aluminium or other suitable material.

The frame 2 is a metallic frame, i.e. a frame having frame members 12 that are at least in part metallic. A metallic frame as described here may include features or components of some non-metallic or composite material, such as plastics material or wood. In particular, the frame may comprise external and internal aluminium profiles with a thermal break of plastics or foam material sandwiched therebetween (see e.g. FIG. 10).

Figure 2:
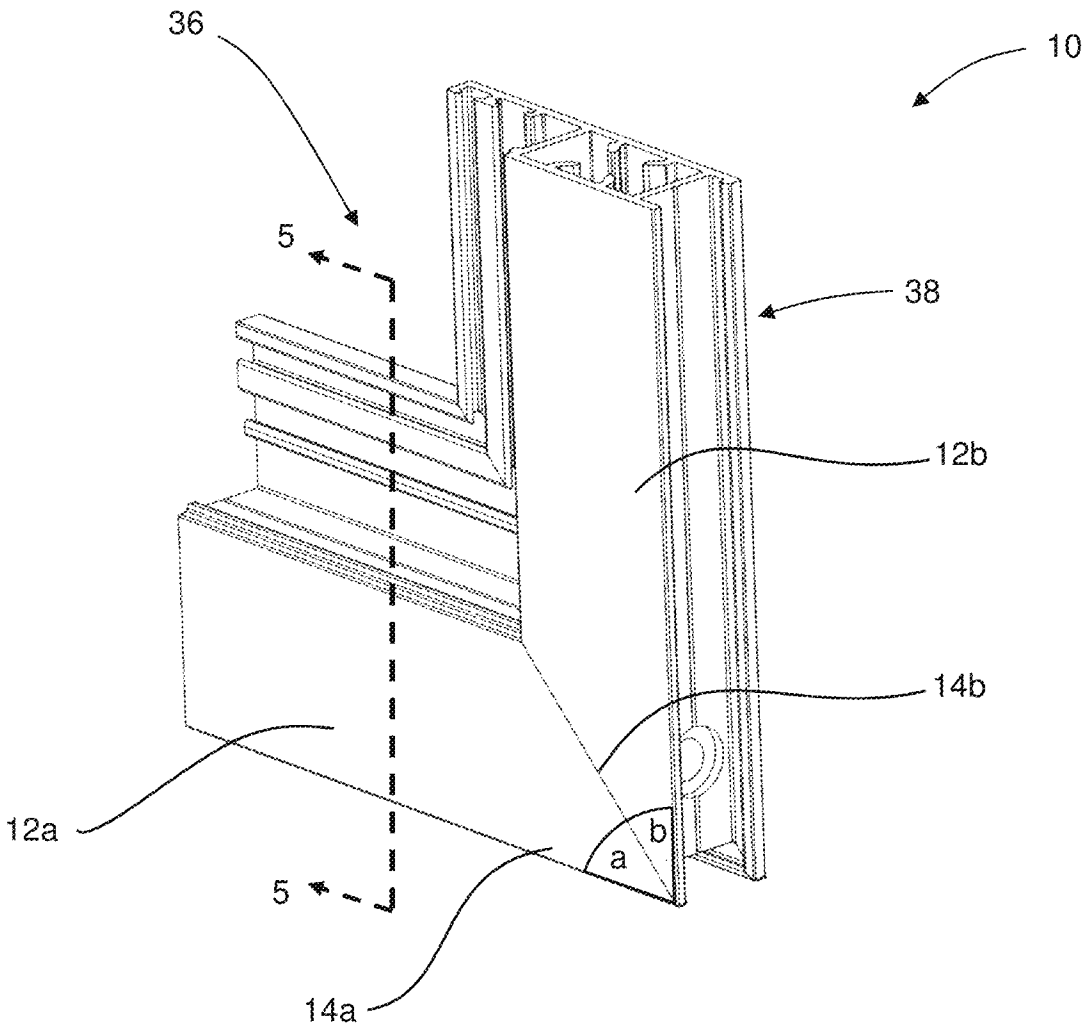
FIG. 2 is an isometric view of a mitre joint according to an embodiment of the present teachings in an assembled state.

A mitre joint for the frame 2 is shown in FIG. 2 in an assembled state, indicated generally at 10. The joint 10 has first and second frame members 12*a*, 12*b*. When the joint 10 is in the assembled state shown in FIG. 1 the frame members 12*a*, 12*b* meet to form a corner of said frame. First ends 14*a*, 14*b* of the frame members 12*a*, 12*b* are angled, as indicated at a, b, so as to form a mitre joint. In this embodiment, the first ends 14*a*, 14*b* are both angled at 45°, i.e. angle a is 45° and angle b is 45°. In alternative embodiments the first ends have some other angle. For example, a is 60° and b is 30°, or a and b have some other suitable value. In such embodiments the first and second frame members are of different width to one another, so that the first ends require different angles to one another.

In this embodiment the frame members 12*a*, 12*b* form a 90° corner. In alternative embodiments the frame has corners of some other angle, e.g. between 60° and 120°. In such embodiments the frame member first ends are of equal angles. In alternative embodiments where the frame has a corner or corners of some non-90° angle, and where the first and second frame members are of different widths to one another, the first ends are of different angles to one another.

Figure 3:
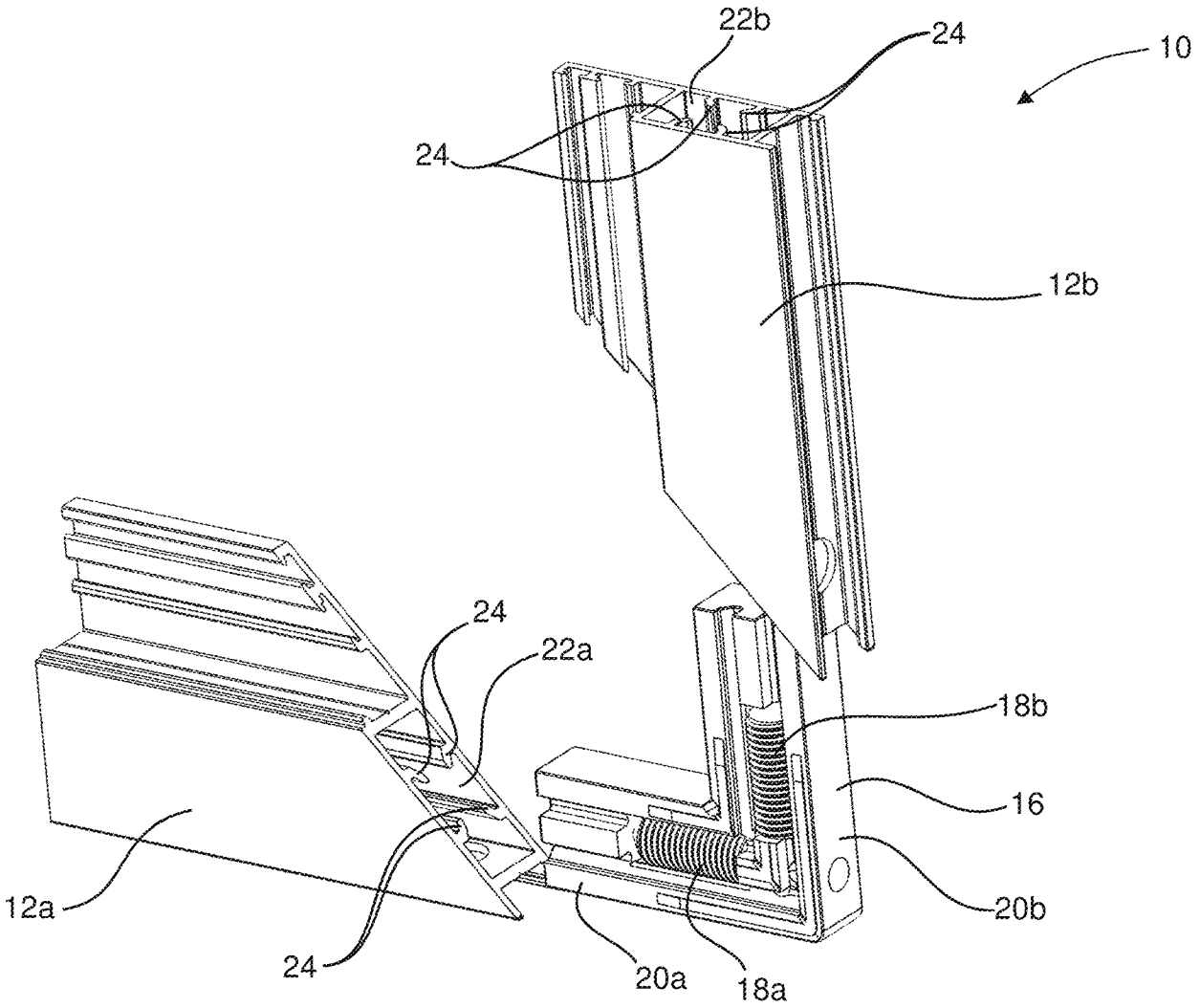
FIG. 3 is an isometric view of the mitre joint of FIG. 2 in a first partially assembled state.
Figure 4:
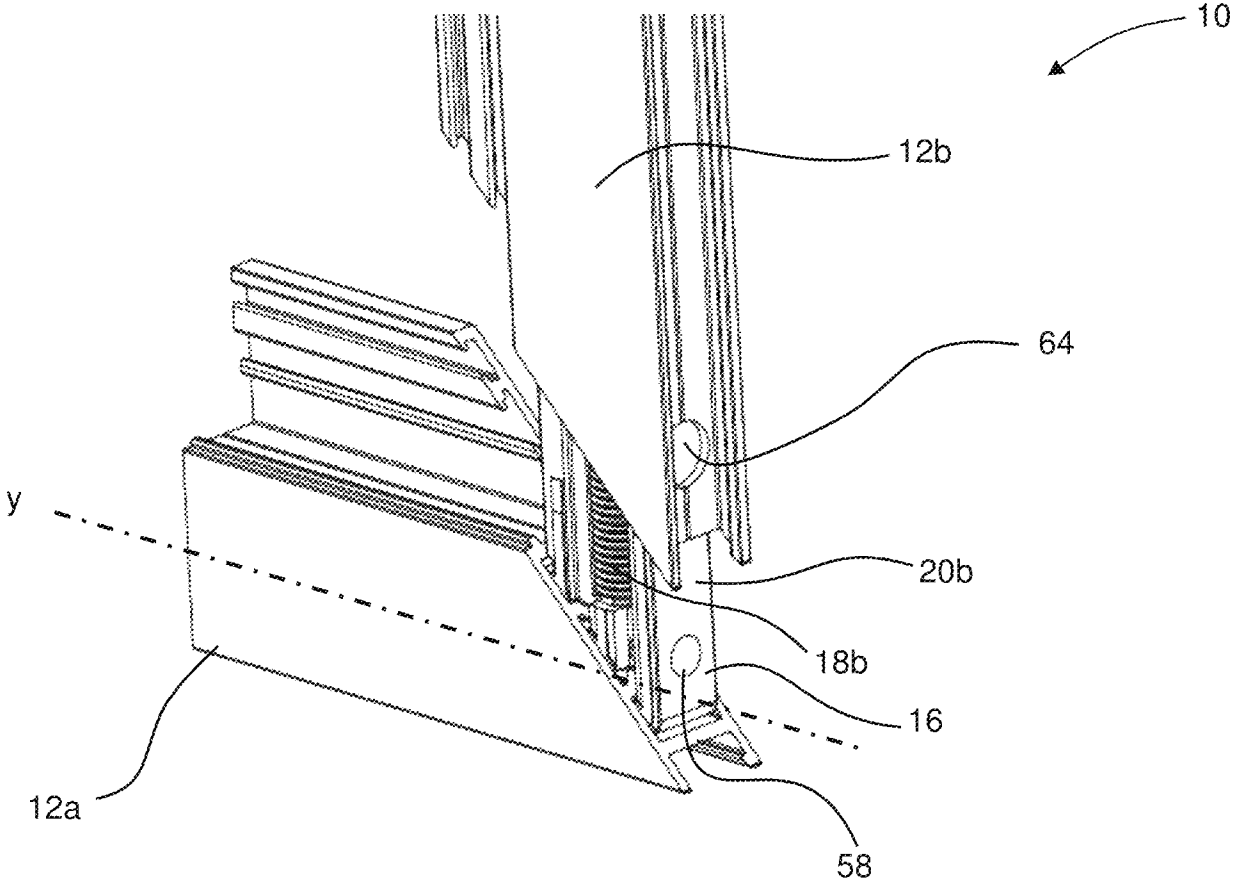
FIG. 4 is an isometric view of the mitre joint of FIGS. 2 and 3 in a second partially assembled state.

The joint 10 has a connector 16, as shown in FIGS. 3 and 4. The connector 16 locates the frame members 12*a*, 12*b* in relation to one another, and is substantially L-shaped. The connector 16 has a first arm 20*a* and a second arm 20*b*. Each first arm 20*a* has a first, free, end 21, and a second end 23. The second ends 23 meet to form a corner. In this embodiment, where the frame members 12*a*, 12*b* form a 90° corner, the connector arm second ends 23 meet at a 90° angle. In embodiments where the frame 2 has corners of some other angle, the connector arms meet at a corresponding angle.

The joint 10 has first and second fasteners 18*a*, 18*b*. The fasteners 18*a*, 18*b* secure the respective first and second frame members 12*a*, 12*b* to the connector 16. In addition, the fasteners 18*a*, 18*b* act to bring the first and second frame members 12*a*, 12*b* together, as described in further detail below.

Each frame member 12*a*, 12*b* defines a hollow profile 22*a*, 22*b*. The connector first arm 20*a* is configured to extend within the first member profile 22*a* to locate the first frame member 12*a*. When the first arm 20*a* extends within the first frame member profile 22*a* the first fastener 18*a* engages the first frame member 12*a*. The connector second arm 20*b* is configured to extend within the second frame member profile 22*b* to locate the second frame member 12*b*. When the second arm 20*b* extends within the second frame member profile 22*b* the second fastener 18*b* engages the second frame member 12*b*.

The engagement of the fasteners 18*a*, 18*b* with the respective frame members 12*a*, 12*b* secures the frame members 12*a*, 12*b* to the connector 16, creating a secure joint 10.

The fasteners 18*a*, 18*b* are supported by the respective connector arms 20*a*, 20*b*, improving ease of assembly of the joint 10. The fasteners 18*a*, 18*b* can be fitted to the connector 16 before the frame members 12*a*, 12*b* are attached thereto.

Figure 5:
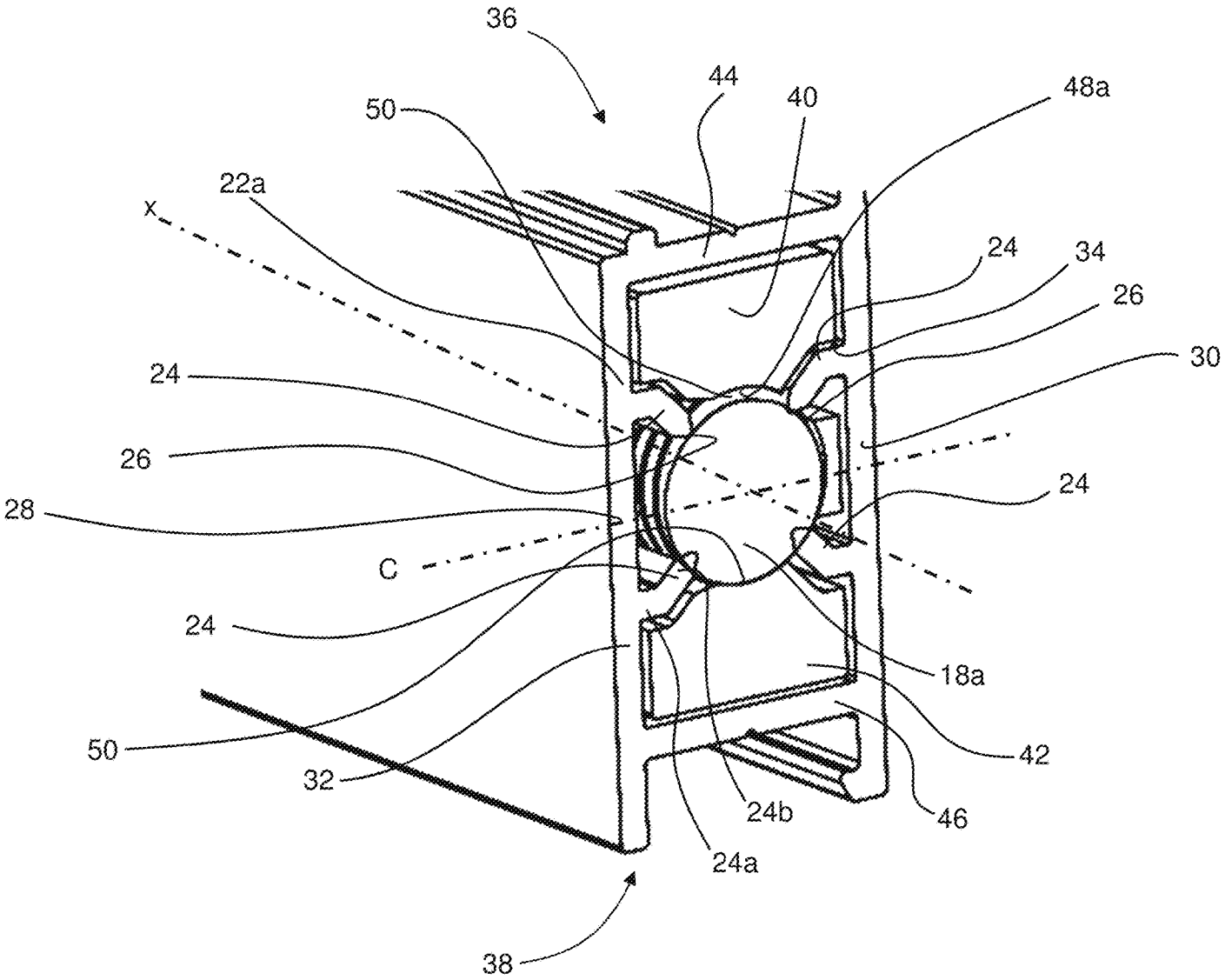
FIG. 5 is a cross-sectional view through the mitre joint of FIG. 2 on the plane 5-5.

The frame members 12*a*, 12*b* have an inner side 36, configured to abut a pane of e.g. glass, and an outer side 38, as indicated in FIGS. 2 and 5. The connector arms 20*a*, 20*b* similarly have an inner side 40 and an outer side 42, corresponding to the inner 36 and outer 38 sides of the frame members 12*a*, 12*b*.

The hollow profiles 22*a*, 22*b* of this embodiment are configured to engage the respective fastener 18*a*, 18*b* when the respective connector arm 20*a*, 20*b* extends within the frame member 12*a*, 12*b*, i.e. when the joint 10 is in the assembled state shown in FIG. 2, and when the joint 10 is in a partially assembled state. That is, when the joint 10 is in the partially assembled state of FIG. 4, where the second frame member 12*b* is partially fitted over the connector second arm 20*b*, engagement between the second fastener 18*b* and the profile 22*b* can be initiated.

Each profile 22*a*, 22*b* defines at least two projections 24 extending from the profile 22*a*, 22*b* to engage the respective fastener 18*a*, 18*b*. The projections 24 engage the fasteners 18*a*, 18*b* at discrete, separate engagement points 26 (see FIG. 5), where each engagement point is distinct from the next. The projections 24 are arranged about the fasteners 18*a*, 18*b* such that the engagement points 26 provide balanced support, e.g. such that the engagement points 26 are evenly arranged about a periphery of each fastener 18*a*, 18*b*. Advantageously, this arrangement provides stability to the engagement between a fastener 18*a*, 18*b* and a frame member 12*a*, 12*b* whilst reducing the amount of material used in the profile 22*a*, 22*b*. Providing an engagement point 26 rather than a solid block or a face of a profile wall or the like for fastener engagement can also improve ease of engagement, in particular where the fastener is a self-tapping screw, due to the reduced amount of material used.

In this embodiment, engagement of the projections 24 and the fastener 18*a*, 18*b* at the engagement points 26 cover less than 25% of the total circumference of each fastener 18*a*, 18*b*. In alternative embodiments, the engagement points cover less than 50% of the total periphery of each fastener, or less than 35%.

In this embodiment, each frame member profile 22*a*, 22*b* defines four projections 24. Two projections 24 extend from a first side 28 of each profile 22*a*, 22*b*, and two projections 24 extend from a second side 30 of each profile 22*a*, 22*b*. The projections 24 oppose one another, and are arranged so that the four engagement points 26 are equidistant to one another about the periphery of the respective fastener 18*a*, 18*b*. In an alternative embodiment with a profile defining four projections, the projections are arranged such that the engagement points form opposing pairs, i.e. so that the projections extending from a first side of each profile create engagement points that oppose those created by the projections extending from a second side of each profile, yet the engagement points are not equidistant from one another.

In alternative embodiments (not shown) each frame member profile defines two projections, or three projections, or five or more projections. In some embodiments with even numbers of projections, the projections are arranged in pairs. In some such embodiments, the pairs of projections are equidistant one another about the periphery of each fastener.

The fasteners 18*a*, 18*b* are in this embodiment supported by the connector arms 20*a*, 20*b* in such a way as to allow limited transverse movement of the fasteners 18*a*, 18*b*, in particular with respect to the inner 40 and outer 42 sides of the connector arms 20*a*, 20*b*. The fasteners 18*a*, 18*b* can thus self-centre with respect to the projections 24, so that the fasteners 18*a*, 18*b* are held equally between all four projections 24.

In particular, in an embodiment where each frame member profile defines three projections, free movement of the fasteners in relation to the supporting connector arms allows the fasteners to self-centre between the projections, i.e. so that each fastener is held equally between all projections.

The projections 24 extend from the respective frame member profile 22*a*, 22*b* in a radial direction. The projections 24 extend radially inwardly from an outer wall 32 to engage the respective fastener 18*a*, 18*b*.

The projections 24 of this embodiment are angled. A first end 24*a* of each projection 24 extends substantially perpendicularly from the outer wall 32. A second end 24*b*, configured to engage a fastener 18*a*, 18*b*, extends at an angle to the first end 24*a*. The second end 24*b* is angled inwardly, towards the second ends 24*b* of the remaining projections 24, so that the second ends 24*b* can engage a fastener 18*a*, 18*b* between them in a radial direction of the fastener. This ensures positive engagement. In this embodiment, the first end 24*a* is at an angle of approximately 60° to the second end 24*b*. In an alternative embodiment the first end is at an angle of between 30° and 120° to the second end, depending on the size and shape of the fastener.

In an alternative embodiment the projections are not angled, but extend in a straight line along their length. In an alternative embodiment each profile defines a combination of angled and straight projections.

The fasteners 18*a*, 18*b* of this embodiment are threaded fasteners. In this embodiment, the fasteners 18*a*, 18*b* are self-tapping grub screws. In an alternative embodiment, some other suitable type of fastener is provided. For example, some other type of threaded fastener is provided, or some other type of fastener that allows for adjustment.

The projections 24 of this embodiment are configured to extend substantially to a minor diameter of each fastener 18*a*, 18*b*. That is, the projections 24 extend to substantially the full depth of the trough of the fastener thread. A high level of engagement between the fasteners 18*a*, 18*b* and the respective frame member 12*a*, 12*b* is thus achieved.

Figure 6:
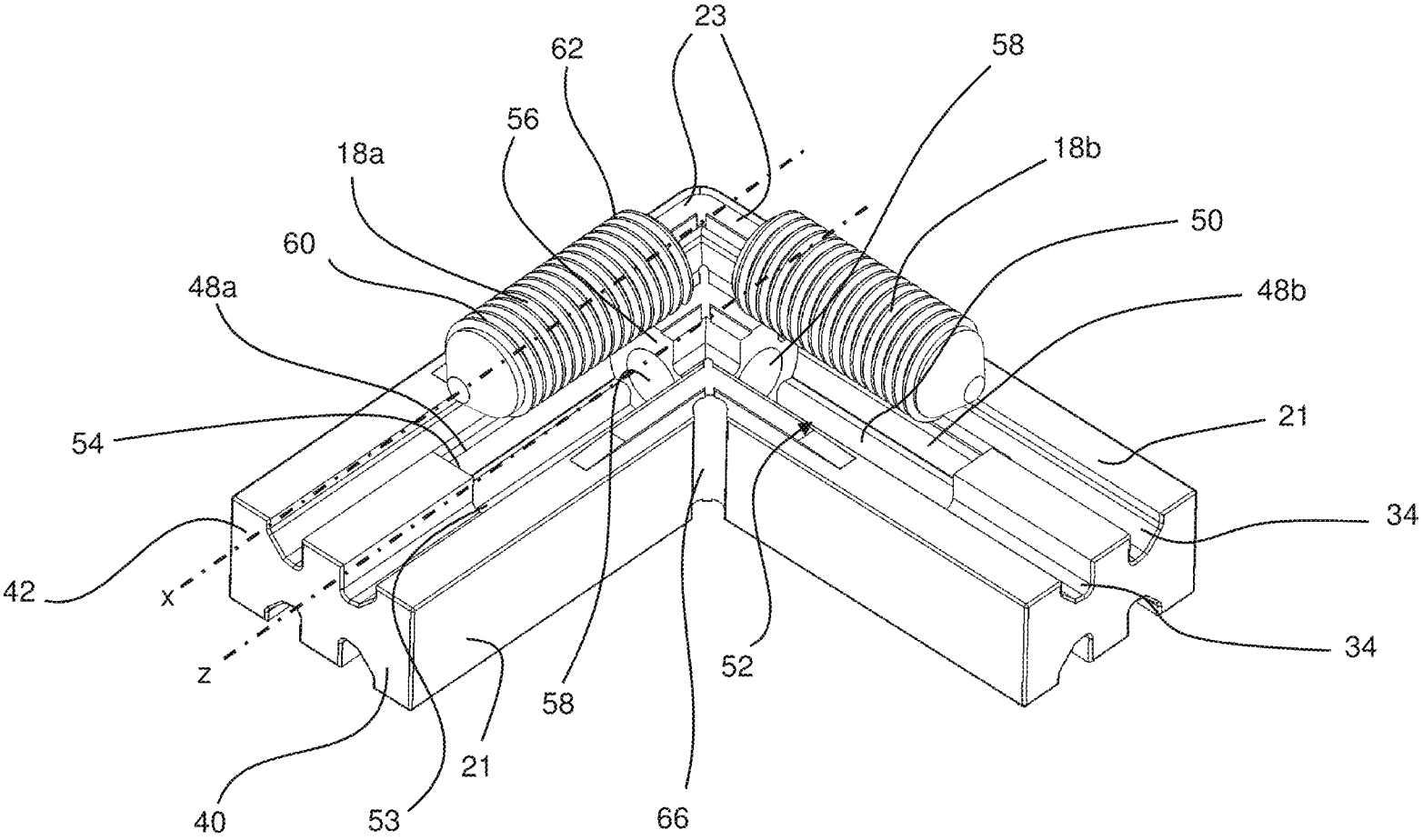
FIG. 6 is an isometric view of a connector and fasteners of the mitre joint of FIGS. 2 to 5.
Figure 7:
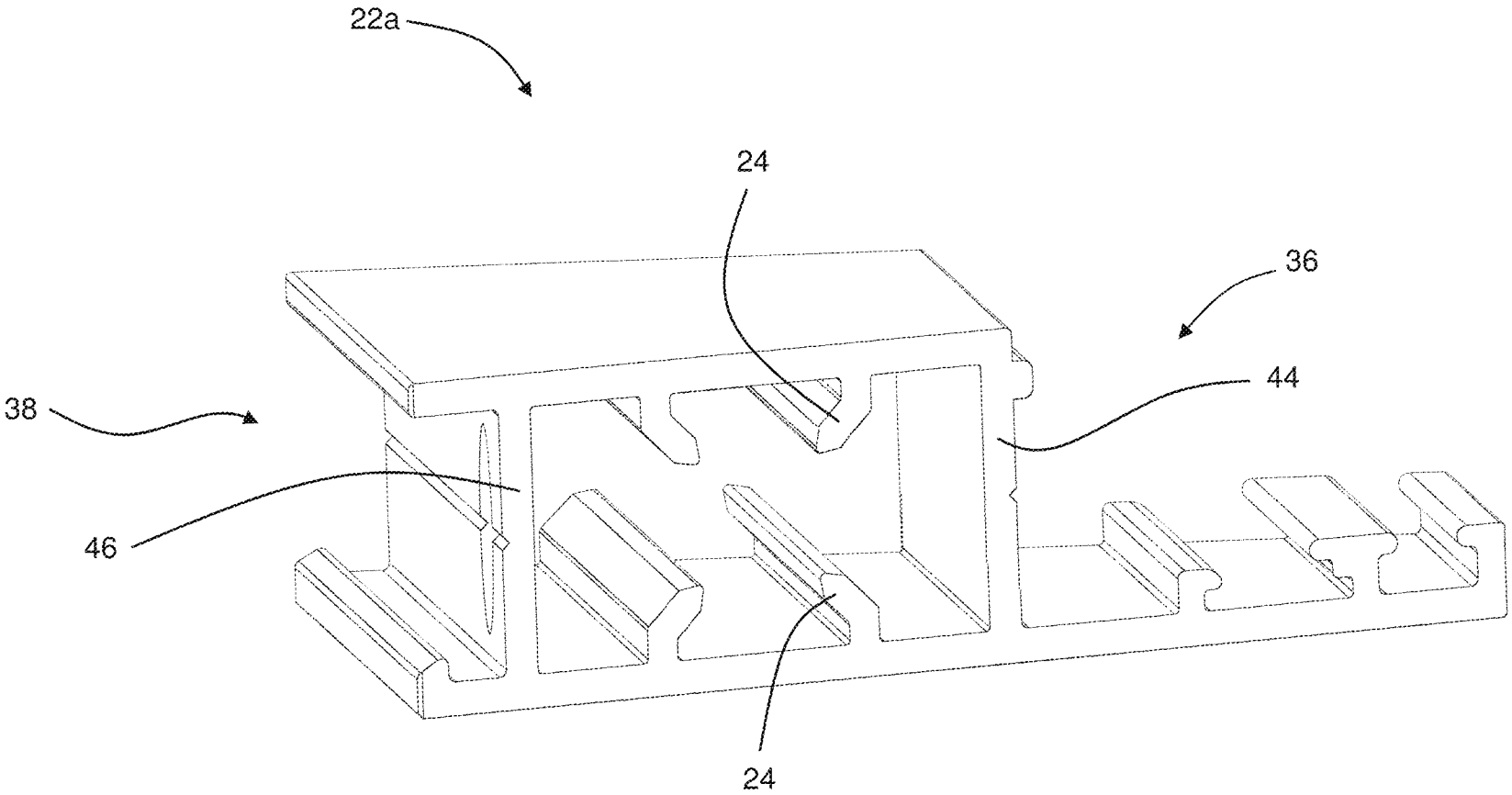
FIG. 7 is a cross-sectional view through a frame member of the mitre joint of FIGS. 2 to 6.

The fasteners 18*a*, 18*b* extend in a longitudinal direction in relation to the respective frame member 12*a*, 12*b*. The fasteners 18*a*, 18*b* each have a longitudinal axis x, as shown in FIG. 6. The frame members 12*a*, 12*b* each have a longitudinal axis y, as shown in FIG. 4. The fasteners 18*a*, 18*b* are supported by the connector 16 such that the fastener longitudinal axis x is substantially parallel to the frame member longitudinal axis y. Each connector arm 20*a*, 20*b* has a longitudinal axis z, as shown in FIG. 6. When the joint 10 is in the assembled state of FIG. 2, the longitudinal axis x of each fastener 18*a*, 18*b* extends substantially parallel to the longitudinal axis z of the respective connector arm 20*a*, 20*b*, and the arm 20*a*, 20*b* extends within the respective frame member 12*a*, 12*b* so that the arm longitudinal axis z is substantially parallel to the frame member longitudinal axis y.

The connector arms 20*a*, 20*b* provide support for the projections 24, improving stability and load distribution of the frame 2. In this embodiment, the connector arms 20*a*, 20*b* define a support 34 for each projection 24 of the respective frame member 12*a*, 12*b*, and are configured to provide support for the projections 24 when the joint 10 is in the assembled state. Free movement between the frame members 12*a*, 12*b* and the connector 16 is therefore limited, stabilising the joint 10.

In this embodiment each support is in the form of a channel 34, shown in FIG. 6. The channels 34 are configured to receive the respective projection 24. Each channel 34 has a cross-section shaped to correspond to that of the projections 24. Each channel 34 is substantially uniform in cross-sectional profile, allowing the frame members 12*a*, 12*b* to be fitted to the connector 16 along the longitudinal axes y, z during assembly.

In this embodiment the channels 34 extend substantially the full length of each connector arm 20*a*, 20*b*, from each first, free end 21 to the connected second ends 23. Support for the projections 24 is thus provided along the connector arms 20*a*, 20*b* from the free first ends 21 to the second ends 23.

The corresponding shape of the projections 24 and the channels 34 also provide location of the connector arms 20*a*, 20*b* in the frame members 12*a*, 12*b*. As shown in FIG. 5, the connector arm inner side 40 is located to the inner side 36 of the projections 24, retained by the relationship between the channels 34 and the projections 24. The connector arm outer side 42 is located to the outer side 38 of the projections 24, retained by the relationship between the channels 34 and the projections 24.

The frame member profiles 22*a*, 22*b* each have an inside edge 44 and an outside edge 46, corresponding to the inner 40 and outer 42 sides of the frame 2. A centreline C extends between the inside 44 and outside 46 edges, equidistant to the inside 44 and outside 46 edges.

As shown in FIG. 5, the projections 24 are configured to engage each fastener 18*a*, 18*b* such that the fastener longitudinal axis x lies substantially on the centreline C. That is, each fastener 18*a*, 18*b* is centrally located in the inner-outer direction in relation to the respective profile 22*a*, 22*b*. The freedom of movement provided to the fasteners 18*a*, 18*b* by the connector arms 20*a*, 20*b* allows the fasteners 18*a*, 18*b* to self-centre with respect to the projections 24. The central location of the fasteners 18*a*, 18*b* in the inner-outer direction aids load distribution within the frame 2. That is, when tightened, the pressure exerted by one frame member on the other frame member at the mitre joint is substantially uniform across the joint.

In an alternative embodiment, the fastener longitudinal axis x is within 5 mm of the centreline C, in a perpendicular direction. In alternative embodiments, the fastener longitudinal axis x is within 4 mm, or within 3 mm, of the centreline C, in a perpendicular direction. In alternative embodiments, the fastener longitudinal axis x is within a quarter, or within a fifth, of the total distance between the inside edge 44 and the outside edge 46 of the centreline C.

In this embodiment, the projections 24 are configured to engage each fastener 18*a*, 18*b* such that the fastener longitudinal axis x is substantially centrally located between the sides 28, 30 of each profile 22*a*, 22*b*. This arrangement aids even load distribution within the profiles 22*a* 22*b*, so that the pressure exerted by one frame member on the other frame member at the mitre joint can be substantially uniform across the hollow profiles of the joint.

In alternative embodiments the fastener longitudinal axis is located closer to one or other of the profile sides 28, 30. The fasteners 18*a*, 18*b* of this embodiment are aligned with one another in relation to the profile sides 28, 30. This further aids an even loading across the joint. In an alternative embodiment, the fasteners are offset with one another with respect to the profile sides. This could enable tools to be simultaneously engaged with each of the fasteners of one connector, which could potentially enable faster adjustment.

In this embodiment, each connector arm 20*a*, 20*b* is configured to engage the respective fastener 18*a*, 18*b* as well as to provide support thereto. Engagement between the fasteners 18*a*, 18*b* and the connector arms 20*a*, 20*b* further improves ease of assembly of the joint 10, as the fasteners 18*a*, 18*b* can be secured to the connector 16 prior to transport. In this embodiment, each connector arm 20*a*, 20*b* defines a recess 48*a*, 48*b* configured to engage the respective fastener 18*a*, 18*b* in a push-fit. That is, the recesses 48*a*, 48*b* are dimensioned such that a fastener of a predetermined size will not fall from either recess 48*a*, 48*b* without intervention.

In this embodiment, each recess 48*a*, 48*b* has concave inner and outer walls 50 configured to receive a fastener 18*a*, 18*b*. Each recess 48*a*, 48*b* is open on a side 52 perpendicular to the inner and outer walls 50. Either side of each recess 48*a*, 48*b* can be open. In this embodiment, the opposing side 53 to the open side 52 is at least partially closed, aiding retention of a fastener 18*a*, 18*b* within each recess 48*a*, 48*b*. On assembly, a fastener 18*a*, 18*b* is pushed between the concave walls 50 via the open side 52. The walls 50 retain the fastener 18*a*, 18*b* in place within the connector 16 in a radial direction.

Each recess 48*a*, 48*b* has first and second end walls 54, 56. The end walls 54, 56 locate each fastener 18*a*, 18*b* in both axial directions. The first end wall 54 is proximal the free end 21 of the respective connector arm 20*a*, 20*b*. In this embodiment the length of the space between the end walls 54, 56 of each recess 48*a*, 48*b* is the same as the length of each fastener 18*a*, 18*b*. As well as further assisting retention of the fasteners 18*a*, 18*b* within their respective recesses 48*a*, 48*b*, the length of the fasteners 18*a*, 18*b* being the same as the length of the recesses 48*a*, 48*b* improves ease of adjustment of the frame members 12*a*, 12*b* in relation to the connector 16.

The second end wall 56, proximal the connector arm end 23, defines an access aperture 58. In this embodiment, the aperture 58 is smaller than the diameter of the fasteners 18*a*, 18*b*, so that the end wall 56 retains the fastener 18*a*, 18*b* within the recess 48*a*, 48*b*.

Figure 8:
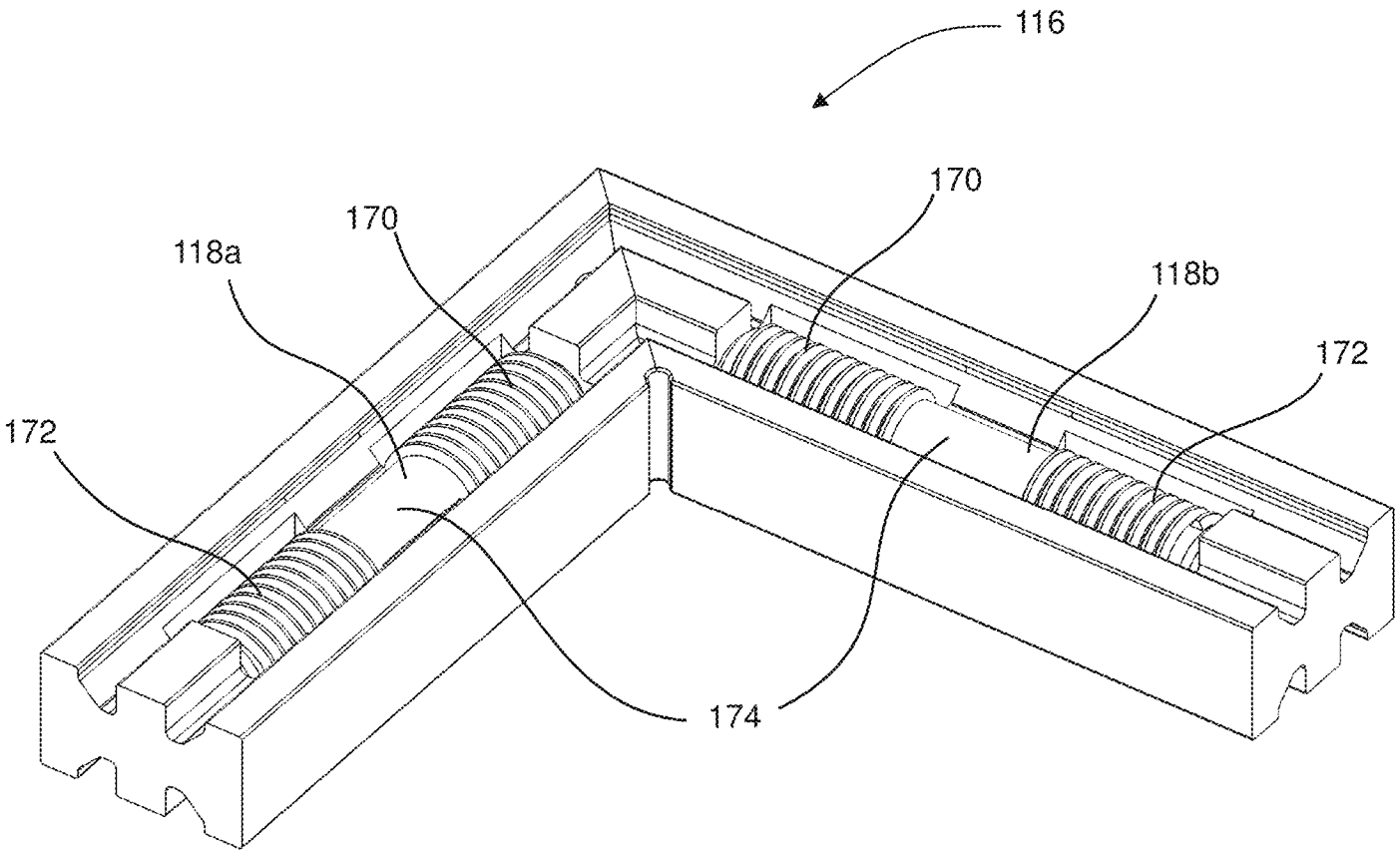
FIG. 8 is an isometric view of a connector with fasteners according to an alternative embodiment of the teachings, for use with the mitre joint of FIGS. 2 to 5.
Figure 9:
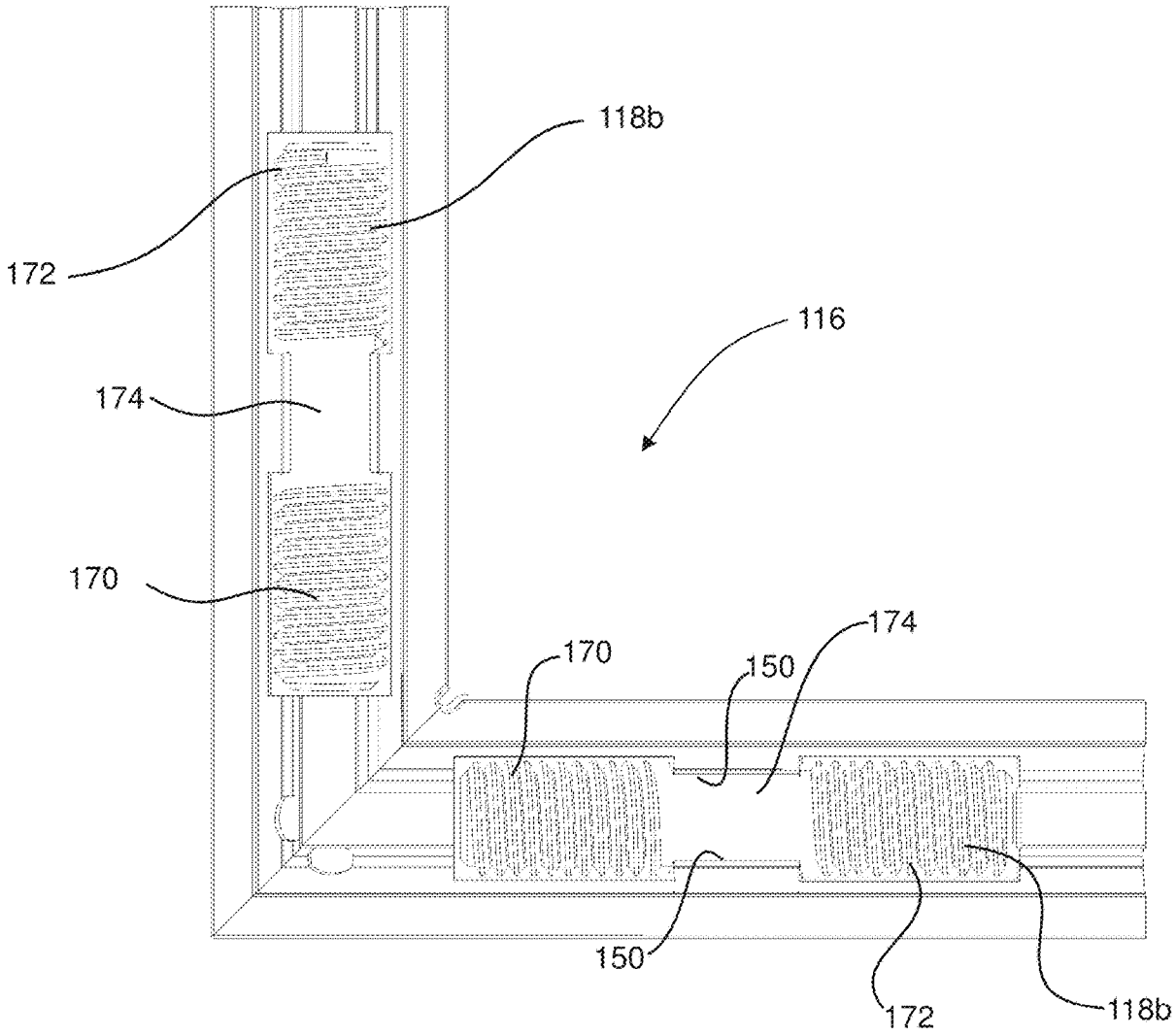
FIG. 9 is a plan view of the connector and fasteners of FIG. 8.

FIGS. 8 and 9 show a further embodiment of the teachings with alternative fasteners. Features corresponding to those of previous embodiments have been given corresponding reference numbers with the additional prefix "1". Only features that differ from those of the previous embodiment are discussed in more depth.

The fasteners of this embodiment are grub screws 118*a*, 118*b* having first and second threaded axial portions 170, 172. The threaded portions 170, 172 are axially separated by an unthreaded portion 174. The recesses 148*a*, 148*b* of this embodiment are configured to engage the respective fastener 118*a*, 118*b* in a push-fit at the unthreaded portion 174. Each recess 148*a*, 148*b* has concave inner and outer walls 150 configured to receive a fastener 118*a*, 118*b* at the unthreaded portion 174, and so to retain the fastener 118*a*, 118*b* in place within the connector 116 in a radial direction.

The fasteners of both embodiments each have a leading end 60 and a trailing end 62. Each leading end 60 lies towards the first end wall 54 of the respective recess 48*a*, 48*b*, i.e. towards the connector arm free end 21. Each trailing end lies towards the second end wall 56. The leading end 60 of each grub screw 18*a*, 18*b* is in this embodiment at least partially conical, or frusto-conical. The conical shape of the leading end 60 aids self-tapping of each grub screw 18*a*, 18*b* with the projections.

In an alternative embodiment, the fastener leading end is not conical, but is flat, or domed, or of some other suitable shape. In a further variant the unthreaded portion is provided at one end (leading 60 or trailing 62) of the grub screws 118*a* and 118*b*.

Each access aperture 58 is configured to provide access to the trailing end 62 for a tool, for example an Allen key or a screwdriver (not shown), for which the trailing end 62 is configured for engagement e.g. with a female hex profile. In one embodiment, the fasteners are female Torx® heads.

A further access aperture 64 is provided in each frame member 12*a*, 12*b*, as shown in FIG. 4. The access apertures 64 are located at the outer side 38 of each first end 14*a*, 14*b*, such that when each frame member 12*a*, 12*b* is in the assembled state shown in FIG. 2, the access apertures 58, 64 of the connector 16 and the frame members 12*a*, 12*b* are aligned with one another. This arrangement allows the first frame member 12*a* to be located, and potentially secured, to the connector 16, then the second frame member 12*b* to be located and secured to the connector 16, as access is provided to the fastener 18*b* via the access aperture 64 of the first frame member 12*b*, and the access aperture 48 of the first connector arm 20*a*. Alternatively, the second frame member 12*b* can be located and potentially secured to the connector 16 prior to location of the first frame member 12*a*.

The access apertures 64 of this embodiment are substantially circular. In this embodiment, the access apertures 64 are larger than the access apertures 58. Clearance is thus provided by the access apertures 64, allowing adjustment of a fastener 18*a*, 18*b* with a tool when the first and second frame members 12*a*, 12*b* are not fully aligned. Adjustment of the location of the frame members 12*a*, 12*b* can therefore take place as the frame members 12*a*, 12*b* approach the assembled state, so that a correct, aligned position of the frame members 12*a*, 12*b* can be reached. Allowance can therefore be made for manufacturing inaccuracies, or damage occurring to components during transport. Both frame members 12*a*, 12*b* can be located on the connector 16 before either is secured.

The connector arms 20*a*, 20*b* are in this embodiment marked to indicate a desired location of each frame member 12*a*, 12*b*, where the frame members 12*a*, 12*b* are approaching the assembled state. That is, where the frame members 12, 12*b* are secured to the connector 16, but are not yet in the assembled state of FIG. 2. Advantageously, the fasteners 18*a*, 18*b* can be turned so that the frame members 12*a*, 12*b* swiftly reach the respective mark (not shown) on the connector arm 20*a*, 20*b*, before finer adjustment takes place. This is of particular advantage where e.g. mastic sealant is to be used between the mitred ends of the frame members 12*a*, 12*b*, where assembly must take place quickly, before the sealant sets.

Adjustment of the frame members 12*a*, 12*b* in relation to the connector 16 is aided by the length of the fasteners 18*a*, 18*b* being the same as the length of the recesses 48*a*, 48*b*. Screwing either fastener 18*a*, 18*b* in a first direction, e.g. clockwise, with a standard right hand threaded fastener, will draw the frame member 12*a*, 12*b* towards the connector 16 due to the fastener 18*a*, 18*b* abutting the first end wall 54. Screwing either fastener 18*a*, 18*b* in a second direction, e.g. anti-clockwise, with a standard right hand threaded fastener, will push the frame member 12*a*, 12*b* away from the connector 16, due to the fastener 18*a*, 18*b* abutting the second end wall 56. The self-tapping grub screws 18*a*, 18*b* of this embodiment create a thread in the second end 24*b* of each projection 24 as they are screwed in the first direction.

The use of the connector arms to support the fasteners, and the means of fitting the fasteners to the connector arms, allow larger fasteners to be used than in the joints of some prior art frames. The use of larger fasteners advantageously allows greater torque to be used when adjusting and securing the frames, and so allows greater clamping force to be applied.

In an alternative embodiment, not shown, the access apertures of the frame members are of some alternative shape, such as lozenge-shaped, to provide clearance. In an alternative embodiment, the access apertures of the frame members are an open-ended slot, with an open end at the first end of each frame member.

In an alternative embodiment, where the connector access apertures are larger than the diameter or width of the fasteners, the fasteners are inserted into a recess of each connector arm in a longitudinal direction, via the access apertures.

In this embodiment, an inside of the connector 16 defines a fillet 66. The fillet 66 relieves stress at the meeting point of the connector arms 20*a*, 20*b*. In alternative embodiments the connector does not define such a fillet.

The frame members 12*a*, 12*b* of this embodiment are of 6063T6 aluminium alloy. In alternative embodiments the frame members are of some other suitable material, such as some other 6063 series aluminium alloy, or a 6060 series aluminium alloy, or another suitable material. In embodiments where the fasteners are self-tapping, the frame members are of a material that is less hard than the material of the fasteners, so that a thread can be formed in the frame members by the fasteners.

The frame members of this embodiment are manufactured by extrusion. Such a method allows the hollow profiles of the frame members to be produced along the length of the frame members. Frame members can therefore be cut to a required length whilst retaining the necessary profile.

The connector 16 of this embodiment is formed by injection moulding, and is of glass filled nylon. In an alternative embodiment the connector is of some other material suitable for injection moulding. In alternative embodiments the connector is die-cast, and is of some other suitable material, such as a zinc based material.

Assembly of the frame 2 is carried out as follows. First and second members 12*a*, 12*b* are located on the connector 16, and the fasteners 18*a*, 18*b* are adjusted to at least partially engage the frame members 12*a*, 12*b*, so that the frame members 12*a*, 12*b* are secured to the connector 16. A third and a fourth frame member 12*c*, 12*d* (see FIG. 1) are located on a further connector 16, and secured in the same way. Two further connectors 16 are used to attach free ends of the first and second frame members 12*a*, 12*b* to free ends of the third and fourth frame members 12*c*, 12*d*, securing the frame member free ends to the connectors 16 in the same way. Once all of the frame members 12*a*, 12*b*, 12*c*, 12*d* are located on connectors 16, the fasteners 18*a*, 18*b* of each joint 10 are adjusted to ensure alignment of the frame members 12*a*, 12*b*, 12*c*, 12*d*.

The frame members and connectors can be assembled in an alternative order, depending on preference.

Once the frame 2 is assembled the pane or panel 3 is fitted, and steps such as attaching beading (not shown) are carried out.

Advantageously, no specialist tools or skilled labour are required for assembly of the frame 2. Depending on the fasteners used, a standard Allen key or screwdriver is all that is required to assemble the frame 2. Assembly can easily be carried out on site. The operations that need to be carried out to assemble the frame are limited, aiding on-site assembly. Once each frame member has been cut to length, and an access aperture made, the frame is ready for assembly. No further recesses need be cut in the frame members to allow assembly. The fasteners can be fitted to the connector prior to transport to a site, further reducing the number of on-site operations required.

Figure 10:
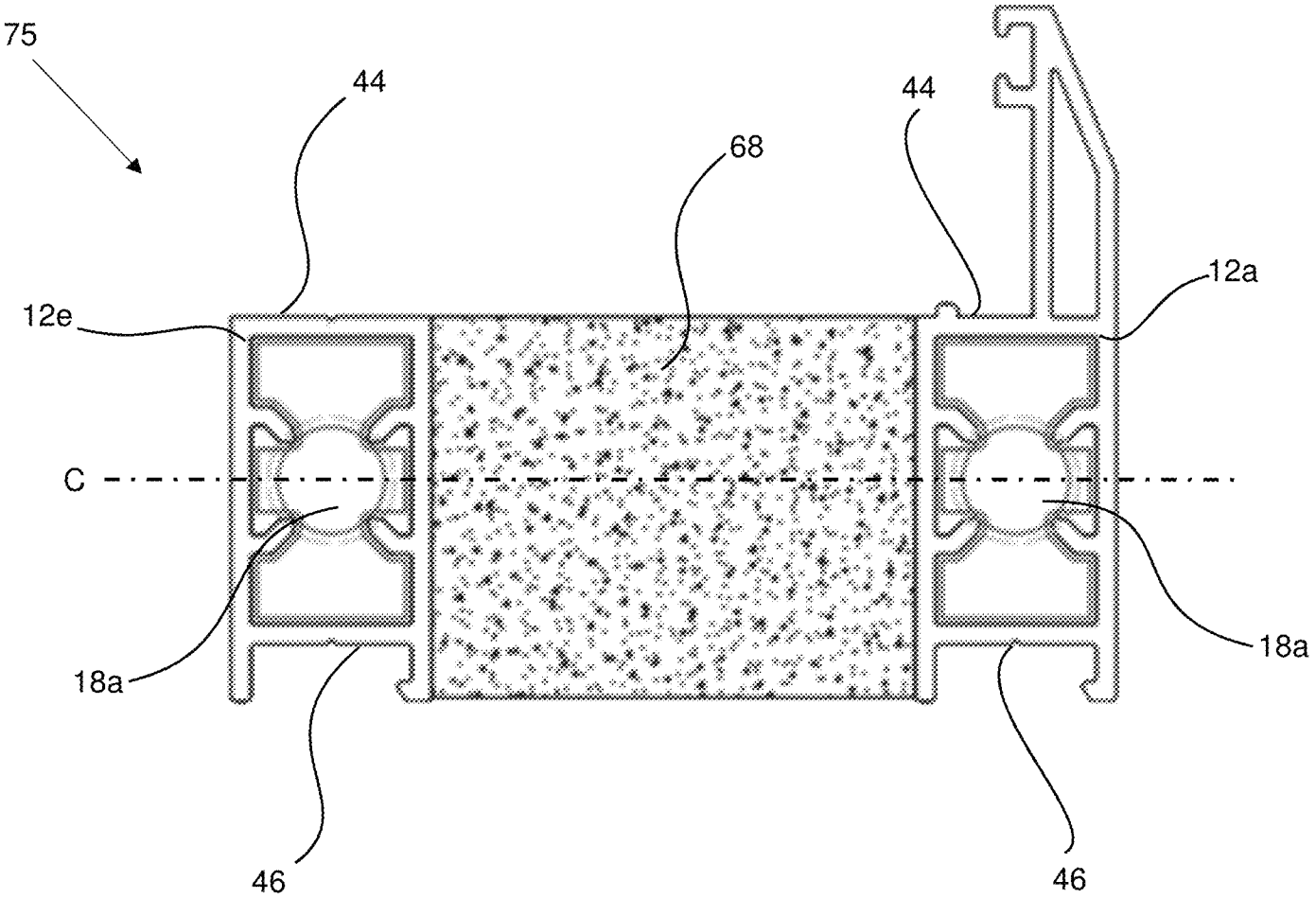
FIG. 10 is a cross-sectional view through a frame of the fenestration unit of FIG. 1.

The frame 2 of this embodiment includes a thermal break configured to limit heat transfer between the external and internal sides of the frame 2. As shown in FIG. 10, a break 68 of low thermal conductivity material such as a plastics or foam material is held between the first, external, frame member 12*a* and an additional, internal, frame member 12*e* to form a frame component 75. A series of frame members are connected to the frame member 12*e* at joints 10, as described above, to form the internal part of the frame 2, with a break 68 extending fully around the frame 2. It can be seen that the fasteners of frame members 12*a* and 12*e* are in mutual alignment and on the centreline C between the inside edge 44 and the outside edge 46, again maintaining an even distribution of loading on the mitred edges as the frame members are brought together to form the joint 10.

Figure 11:
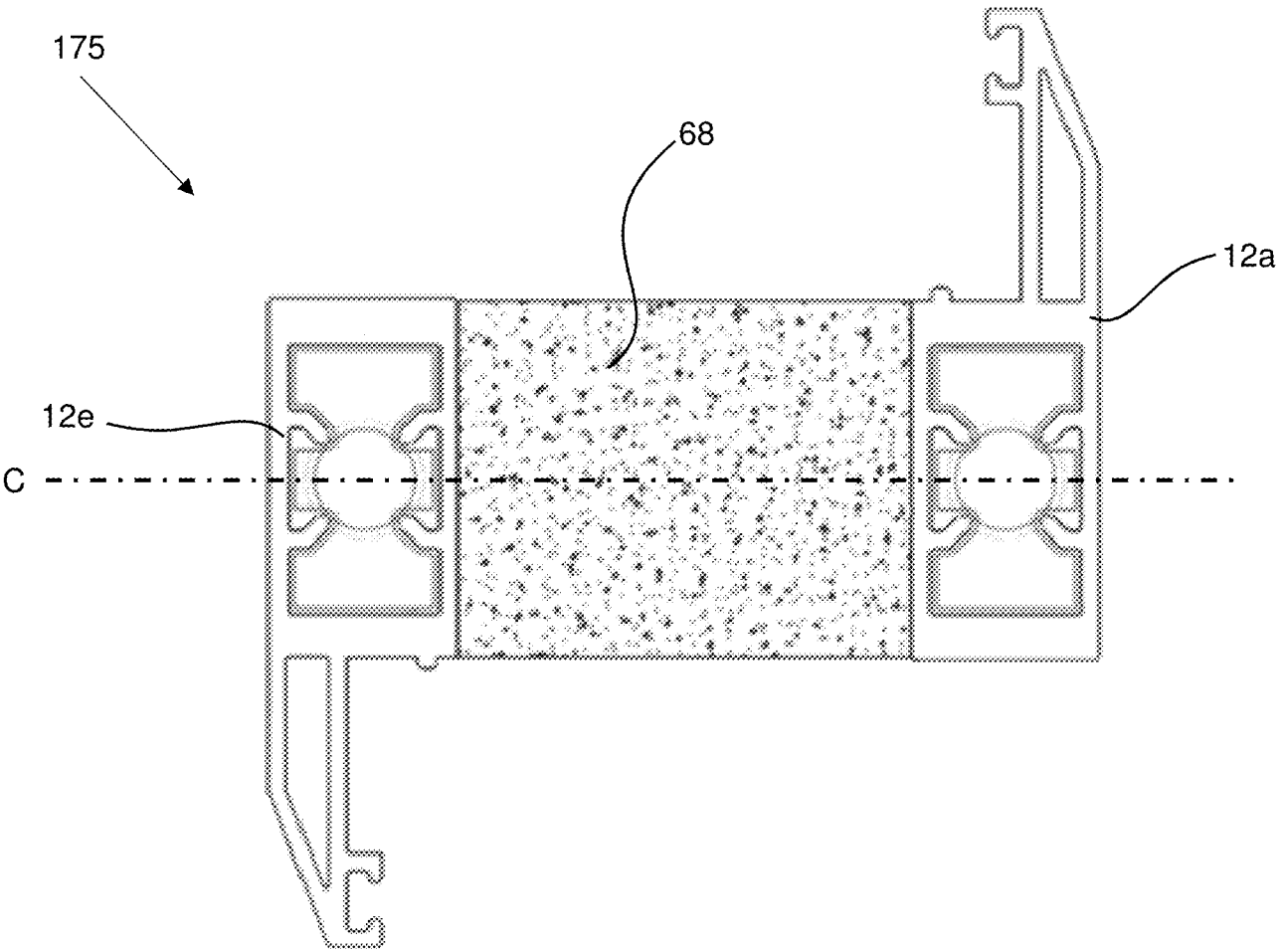
FIG. 11 is a cross-sectional view through an alternative example of a frame.

An alternative example of a thermal break 168 is shown in FIG. 11 sandwiched between two frame members 12*a* and 12*e* to form a frame component 175. A joint 10 as described above can be used in a frame having such a thermal break, where frame members with a profile 22*a*, 22*b* as described above are provided.

The joint 10 described above can be used with frame members of different types, resulting in different types of frame. One example, as shown in FIG. 10, is the L-shaped frame component 75 forming the frame 2 of this embodiment.

The invention claimed is:

1. A mitre joint for a metallic frame of a fenestration unit, the joint comprising:

first and second frame members;

a connector configured to locate the first and second frame members in relation to one another; and first and second fasteners configured to secure the first and second frame members to the connector;

wherein the connector comprises a first arm configured to extend within a hollow profile defined by the first frame member, and a second arm configured to extend within a hollow profile defined by the second frame member;

wherein a longitudinal axis of each of the first and second fasteners is configured to be parallel to a longitudinal axis of the respective connector arm;

wherein each of the first and second fasteners is configured to engage the respective frame member when the respective connector arm extends within said frame member;

wherein each frame member profile defines at least two projections extending from the profile to engage said fastener;

wherein each projection of the frame member engages the fastener at an engagement point, and wherein the projections are configured such that the engagement points are equidistant about a periphery of the fastener; and wherein each connector arm defines a support for each projection, each support being configured to contact said projection when the connector arm extends within the respective frame member.

2. The joint of claim 1 wherein the first arm is configured to support the first fastener and the second arm is configured to support the second fastener.

3. The joint of claim 1 wherein less than 50% of a periphery of each fastener is engaged by the projections.

4. The joint of claim 1 wherein each frame member profile defines an even number of projections, wherein each projection of a frame member engages the fastener at an engagement point, and wherein the projections are configured such that the engagement points are arranged in pairs about a periphery of the fastener.

5. The joint of claim 1 wherein each projection extends from the respective frame member profile in a radial direction.

6. The joint of claim 1 wherein each fastener is a threaded fastener, and wherein each projection of a respective frame member extends to a minor diameter of said fastener; optionally wherein each fastener is a grub screw.

7. The joint of claim 1 wherein each support comprises a channel configured to receive the projection, optionally wherein each channel extends to each end of the respective connector arm.

8. The joint of claim 1 wherein the at least two projections are configured to locate the first and second arms within the respective frame member profile, optionally wherein each connector arm comprises an inner side, configured for location at an inner side of the projections, and an outer side, configured for location at an outer side of the projections.

9. The joint of claim 1 wherein each of the hollow profiles comprises an inside edge and an outside edge, and wherein the projections are configured to engage each fastener such that the longitudinal axis of said fastener is positioned within 4 mm in a perpendicular direction of a centreline equidistant between the inside edge and the outside edge, optionally wherein the longitudinal axis is within 3 mm of the centreline in a perpendicular direction, optionally wherein the longitudinal axis is on the centreline.

10. The joint of claim 1 wherein each connector arm is configured to engage the respective fastener, optionally wherein each connector arm defines a recess configured to engage the respective fastener, optionally wherein each recess has at least one concave side wall configured to receive the respective fastener, and/or wherein each fastener is confined in a first axial direction, towards a free end of the connector arm, optionally wherein each fastener is confined in both axial directions.

11. The joint of claim 1 wherein an outer edge of each frame member defines an aperture configured to provide adjustment access to the fastener configured to engage the remaining frame member.

12. The joint of claim 1 wherein each fastener is a threaded fastener, optionally wherein each fastener is a self-tapping threaded fastener, and/or wherein each fastener comprises a frusto-conical leading end, optionally wherein each fastener comprises at least one threaded axial portion and at least one unthreaded axial portion; optionally wherein, where each connector arm is configured to engage the respective fastener, each connector arm is configured to engage the respective fastener at an unthreaded portion.

13. The joint of claim 1 wherein the first connector arm meets the second connector arm such that the angle between a longitudinal axis of each of the connector arms is between 60° and 120°.

14. The joint of claim 1 wherein the frame members are at least partially of metallic material.

15. The joint of claim 1 wherein each projection defines a longitudinal axis parallel to the longitudinal axis of the respective connector arm with which it engages.

16. A connector for connecting first and second frame members to form a mitre joint wherein the connector comprises a first arm configured to extend within a hollow profile defined by the first frame member, and a second arm configured to extend within a hollow profile defined by the second frame member; and first and second fasteners configured to secure the first and second frame members to the connector;

wherein a longitudinal axis of each of the first and second fasteners is configured to be parallel to a longitudinal axis of the respective connector arm;

wherein each of the first and second fasteners is configured to engage the respective frame member when the respective connector arm extends within said frame member;

wherein the first and second fasteners are each configured for engagement with the hollow profiles of the first and second frame members at engagement points, the hollow profiles each defining at least two projections extending from the hollow profile to engage with the respective fastener;

wherein the first and second fasteners are each configured to extend into the hollow profiles such that the engagement points are equidistant about a periphery of the fastener; and wherein each connector arm defines a support for each projection, each support being configured to contact said projection when the connector arm extends within the respective frame member.

17. A mitre joint for a metallic frame of a fenestration unit, the mitre joint comprising:

first and second frame members;

a connector configured to locate the first and second frame members in relation to one another; and first and second fasteners configured to secure the first and second frame members to the connector;

wherein the connector comprises a first arm configured to extend within a hollow profile defined by the first frame member, and a second arm configured to extend within a hollow profile defined by the second frame member;

wherein a longitudinal axis of each of the first and second fasteners is configured to be parallel to a longitudinal axis of the respective connector arm;

wherein each of the first and second fasteners is configured to engage the respective frame member when the respective connector arm extends within said respective frame member;

wherein each fastener is confined in both axial directions such that the connector can be pushed out by the fastener during disassembly and/or adjustment; and wherein each connector arm defines a support for each projection, each support being configured to contact said projection when the connector arm extends within the respective frame member.

* * * * *